US006829869B1

(12) United States Patent
Savoie

(10) Patent No.: US 6,829,869 B1
(45) Date of Patent: Dec. 14, 2004

(54) CHANNEL BAR WITH SPRING LOADED HUB CONNECTOR FOR A DISPLAY FRAMEWORK

(75) Inventor: Troy S. Savoie, Burnsville, MN (US)

(73) Assignee: Skyline Displays, Inc., Eagan, MN (US)

( * ) Notice: Subject to any disclaimer, the term of this patent is extended or adjusted under 35 U.S.C. 154(b) by 0 days.

(21) Appl. No.: 10/369,220

(22) Filed: Feb. 18, 2003

Related U.S. Application Data

(60) Provisional application No. 60/357,270, filed on Feb. 15, 2002.

(51) Int. Cl.[7] ..... E04H 12/00

(52) U.S. Cl. ..... 52/648.1; 52/646; 52/652.1; 52/645; 52/641; 135/143; 135/122

(58) Field of Search ..... 52/645, 648.1, 52/646, 641, 653, 652.1, 648, 651.7, 643, 239, 36.1; 403/170; 135/143, 122, 145

(56) References Cited

U.S. PATENT DOCUMENTS 4,280,521 A * 7/1981 Zeigler ..... 135/120.3
4,471,548 A * 9/1984 Goudie ..... 40/610
4,627,210 A * 12/1986 Beaulieu ..... 52/646
4,655,022 A * 4/1987 Natori ..... 52/646
4,658,560 A * 4/1987 Beaulieu ..... 52/646
4,703,594 A * 11/1987 Reber ..... 52/81.3
5,125,205 A * 6/1992 Wichman ..... 52/646
5,165,207 A * 11/1992 Oehlke ..... 52/81.3
5,274,980 A * 1/1994 Zeigler ..... 52/646
5,327,700 A * 7/1994 Sorenson et al. ..... 52/109
5,367,852 A * 11/1994 Masuda et al. ..... 52/651.06
5,390,452 A * 2/1995 Eckert ..... 52/71
5,498,094 A * 3/1996 Imai ..... 403/171
5,501,051 A * 3/1996 Harlan ..... 52/646
5,640,811 A * 6/1997 Boyle et al. ..... 52/86
5,797,695 A * 8/1998 Prusmack ..... 403/170
6,250,039 B1 * 6/2001 Karten et al. ..... 52/645
6,591,571 B2 * 7/2003 Fritsche et al. ..... 52/655.1

* cited by examiner

*Primary Examiner*—Peter M. Cuomo
*Assistant Examiner*—Erika Garrett
(74) *Attorney, Agent, or Firm*—Patterson, Thuente, Skaar & Christensen, P.A.

(57) ABSTRACT

A support and attachment brace for a collapsible display structure. The support and attachment brace is attachable between two vertically adjacent hubs of the collapsible display structure, and includes an elongated rigid bar or brace with opposing ends. A first end has a tab with an aperture adapted to receive and engage a fastening button projecting from a first hub assembly. The second end has a slide mechanism having a slide with an open notch. The slide is retractable so that the brace may be aligned with a fastening button projecting from the second hub without the need for forcing the hubs apart. Once in position, the slide is extendable so that the open notch is engaged with the fastening button of the second hub. The support and attachment brace is adapted so as to enable multiple support and attachment braces to be attached to the structure in a vertical column arrangement for providing vertical support and rigidity to the display structure.

22 Claims, 4 Drawing Sheets

CHANNEL BAR WITH SPRING LOADED HUB CONNECTOR FOR A DISPLAY FRAMEWORK

This application claims priority under 35 U.S.C. §119(e) to U.S. Provisional Patent Application Ser. No. 60/357,270 filed Feb. 15, 2002, said provisional application being fully incorporated herein by reference.

FIELD OF THE INVENTION

This invention relates collapsible frameworks for portable displays, and more specifically, to vertical braces for collapsible portable display frameworks.

BACKGROUND OF THE INVENTION

Portable display structures are widely used to form temporary enclosures and to display graphic and other informational materials in public settings. For example, portable structures are widely used to form booths at trade shows and other such exhibitions. It is generally desirable that portable display structures be self-supporting for maximum flexibility in use, and collapsible to enable easy transportation.

Collapsible self-supporting structures may have a network of support rods which are pivotally joined together by hub assemblies for movement between a collapsed, compact position for storage or transportation and an open or erect condition in which the desired structural shape is attained. One example of such a structure is disclosed in U.S. Pat. No. 4,627,210, commonly owned by the owners of the present invention, and hereby fully incorporated herein by reference. Such structures are commercially available and are commonly used to form the backdrop of a portable display. The framework may be covered by sheets of fabric or other flexible material. The material may be imprinted with graphics, or may serve as a substrate for attachment of items. In addition, items may be attached to, or suspended from, the framework itself.

Collapsible structures, such as described above, may use removable rigid brace members to provide vertical support to the structure. These vertical braces, sometimes known as channel bars, may attach to the front of the structure and also serve as a means for attaching display elements to the structure.

A framework and system of channel bar attachment is disclosed in U.S. Pat. No. 4,658,560, to Beaulieu, which is incorporated fully herein by reference. In this system, the channel bar support and attachment braces have a closed aperture at one end of the channel bar and a u-shaped notch at the other end. To attach the channel bar, the channel bar end having the closed aperture is placed over the fastening button of a first hub. The collapsible framework has a certain, limited, amount of resilience so that a second vertically aligned hub may be pulled slightly apart from the first hub. With the hubs slightly spread apart, the channel bar may be positioned between the hubs so that the u-shaped notch engages the fastening button of the second hub. When the resilience of the structure returns the hubs to normal position, the channel bar is slightly axially compressed between the fastening buttons of the hubs. The channel bar is held by the closed aperture over a fastening button at one end, and by engagement of the u-shaped notch with the fastening button at the other end.

A problem with the support and attachment brace system described has been that it is necessary to physically deform the framework slightly by pulling the aligned hub assemblies away from each other in order to attach the channel bars. This is inconvenient, requires physical strength on the part of the person setting up or taking down the display, and causes stress on the hub assemblies and frame members. What is needed in the industry is a support and attachment brace that can be easily and quickly attached and detached from the framework without the need to deform the framework.

SUMMARY OF THE INVENTION

A support and attachment brace for a collapsible display structure that substantially meets the aforementioned needs of the industry is provided in the present invention. The support and attachment brace is attachable between two vertically adjacent hubs of a collapsible display structure, and includes an elongated rigid bar or brace with opposing ends. A first end has a tab with an aperture adapted to receive and engage a fastening button projecting from a first hub assembly. The second end has a slide mechanism having a slide with an open notch. The slide is retractable so that the brace may be aligned with a fastening button projecting from the second hub without the need for forcing the hubs apart. Once in position, the slide is extendable so that the open notch is engaged with the fastening button of the second hub, the brace being thereby affixed to the display structure. The support and attachment brace is adapted so as to enable multiple support and attachment braces to be attached to the structure in a vertical column arrangement for providing vertical support and rigidity to the structure.

A magnetic strip affixed along the length of the brace provides a means for releasably attaching a sheet of material to the brace to cover the panel structure with a display or graphic representation. A plurality of vertically aligned slots in the brace may be provided for releasably attaching shelving or other display accessories to the panel structure.

The present invention advantageously provides vertical supportive strength and rigidity to collapsible display structures and further permits attachment of various display accessories, such as sheets of material, shelving, etc. The braces quickly and easily interconnect with vertically aligned hub assemblies and require no special adaptations of the support rods or the panel structure.

In one embodiment, a support and attachment brace for a collapsible display structure having a plurality of projecting fastening buttons is provided. The brace includes an elongate rigid bar portion having a pair of opposing ends. A tab portion having an aperture formed therein projects axially from one of the opposing ends. The aperture is adapted to receive and engage one of the projecting fastening buttons on the display structure. The brace further includes a slide portion at the other end of the rigid bar portion. The slide portion has a notch adapted to engage the fastening button of another hub of the display structure. The slide portion is selectively axially slidably positionable in at least a first favored extended position for engaging the notch with the fastening button, and a second favored retracted position for disengaging the notch from the fastening button.

DETAILED DESCRIPTION OF THE PREFERRED EMBODIMENT

Figure 1:
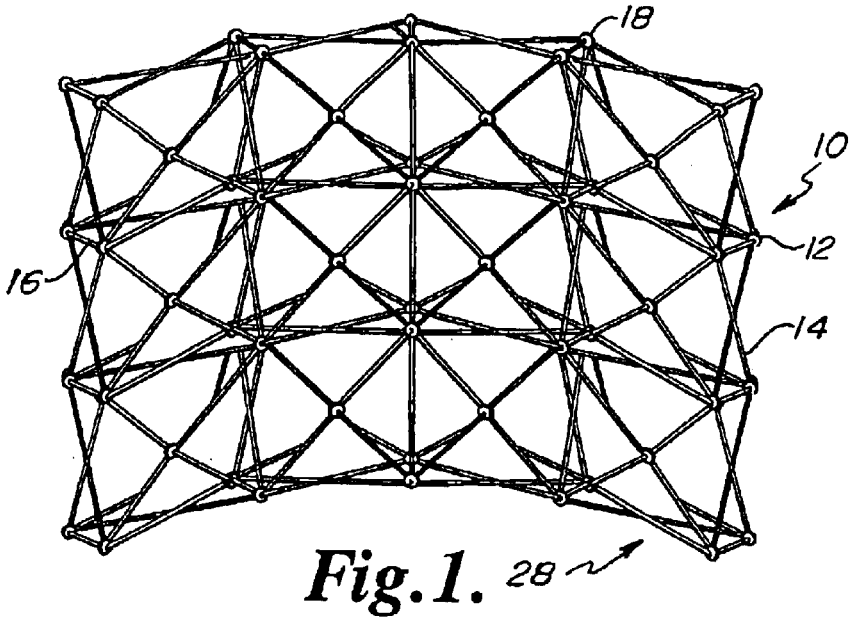
FIG. 1 is a perspective view of a collapsible display framework.

Referring to FIGS. 1 through 4, a typical collapsible display structure 10 generally includes hub assemblies 12, support rods 14, and support and attachment braces 16. Support rods 14 are pivotally attached to hub assemblies 12, so as to form a foldably collapsible skeletal frame 18. Each hub assembly 12 has an outer face 20 with a centrally located and outwardly facing fastening button 22 thereon. Button 22 includes stub shaft or shank 24 and enlarged head 26. Support and attachment braces 16 attach to the front side 28 of display structure 10 extending vertically between the fastening buttons 22 of vertically adjacent hubs 12.

As shown in FIGS. 5 through 9C, support and attachment brace 16 has a front face 30, back side 32, stiffening sides 34, and a pair of opposing ends 36, 38. A flat tab portion 39 projects axially from end 36, and has an aperture 40 formed therein. Aperture 40 has a diameter slightly larger than the diameter of head 26 of button 22. Slide mechanism 42 is disposed on back side 32 at end 38. End cap 44 having an arcuate shaped cutout portion 46 is disposed on front face 30 at end 38.

Slide mechanism 42 generally includes body portion 48, slide portion 50, and compression spring 52. Body portion 48 has an interior facing side 54 with a recessed region 56 formed therein. Exterior side 55 faces outwardly when slide mechanism 42 is assembled with brace 16. Recessed region 56 is bounded by sides 58, 60, which have cutout regions 62, 64. Guide shoulders 66 are formed along each side of recessed region 56, inside of sides 58, 60. Recessed region 56 has a generally rectangularly shaped cutout portion 68 at distal end 70. Fastening portion 72 is disposed at proximal end 74, presenting a transverse vertical surface 76. Fastening portion 72 has a pair of apertures 78 for receiving fasteners 80.

Slide portion 50 has an interior facing side 82 confronting interior facing side 54 of body portion 48 when slide mechanism 42 is assembled. Interior facing side 82 has a pair of spaced apart ridges 84. Ridges 84 are spaced inward from edges 86 of slide portion 50 by a distance substantially equal to the width of guide shoulders 66 of body portion 48, so that the exterior side 88 of ridges 84 confronts the sides 90 of guide shoulders 66 when slide mechanism 42 is assembled. A recessed region 92 is formed inside of ridges 84. Rectangular shaped raised portion 94 is formed at distal end 96, and has a distally oriented open notch 98. Notch 98 has a width W2 selected so as to be slightly larger than the diameter of shank 24 of button 22, and smaller than the diameter of head 26. On exterior side 99, which confronts back side 32 when slide mechanism 42 is assembled to brace 16, a recessed region 101 is formed around notch 98 as shown. Recessed region 101 is sized so as to receive head 26 of fastening button 22. Raised portion 94 presents a transverse vertical surface 100 within recessed region 92. A cutout area 102 is provided in proximal end 104. A pair of ears 106, having a gripping surface 108 project laterally from slide portion 50 and fit within cutout regions 62, 64 when slide mechanism 42 is assembled.

One end 109 of compression spring 52 engages projection 110 extending from vertical surface 76 of body portion 48. The other end 112 of compression spring 52 engages vertical surface 100 of slide portion 50, and biases slide portion 50 distally relative to body portion 48. Compression spring 52 is viewable from the exterior of assembled slide mechanism 42 through cutout 102.

Figure 9:
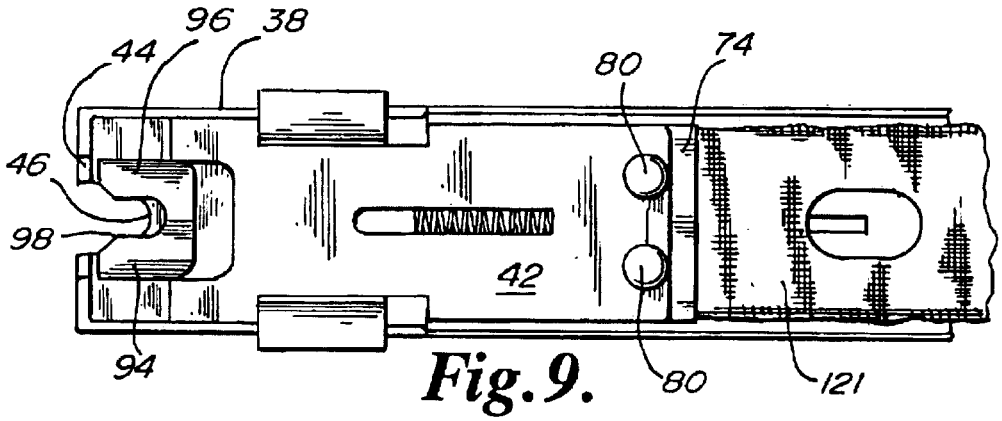
FIG. 9 is a view of the slide mechanism of a brace according to the present invention.
Figure 9A:
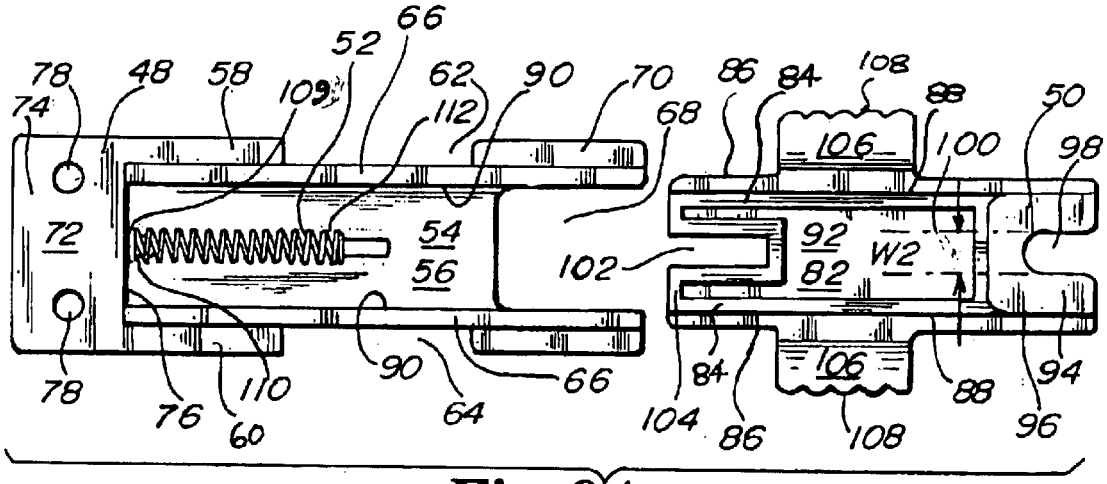
FIG. 9A is a view of the slide mechanism in a disassembled condition.
Figure 9B:
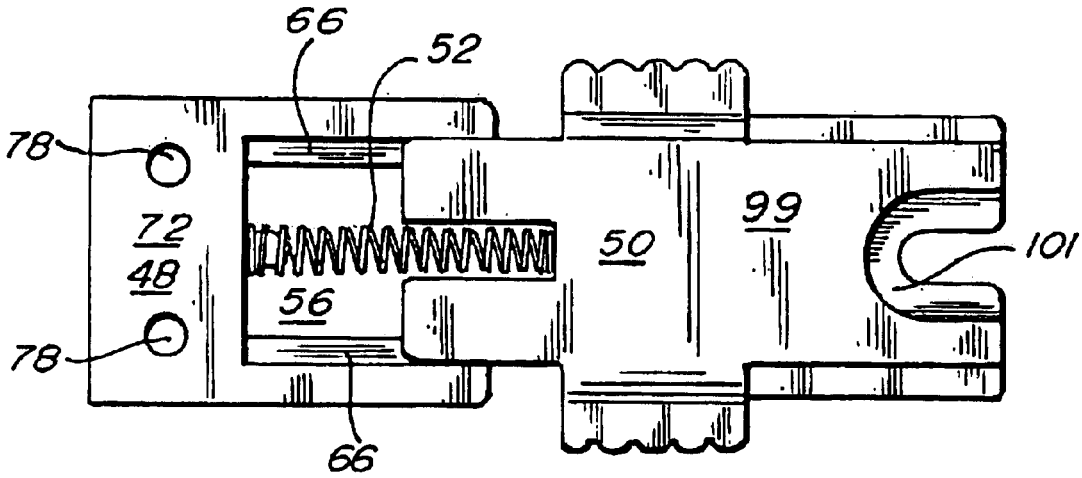
FIG. 9B is view of the inner facing side of the slide mechanism in a partially assembled condition.
Figure 9C:
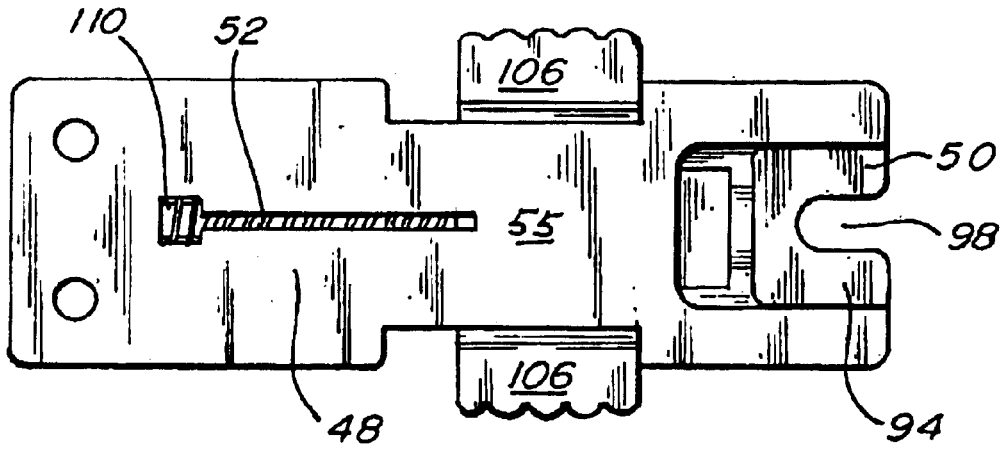
FIG. 9C is a view of the outer facing side of the slide mechanism in a partially assembled condition.

Slide mechanism 42 is attached on back side 32 of end 38 of support and attachment brace 16 between sides 34 as depicted in FIG. 9. Slide portion 50 is captured between body portion 48 and back side 32. Notch 98 projects outwardly from end 38 and roughly aligns with cutout portion 46.

In operation, a first support and attachment brace 16 is attached to a display structure 10 by passing aperture 40 of the brace 16 over head 26 of a fastening button 22 of a first hub assembly 12 of the display structure 10. The inside edge 116 of the aperture 40 engages the shank 24 of the fastening button 22 of the first hub 12. Slide portion 50 of the slide mechanism 48 on the same support and attachment brace 16 is then moved proximally against the bias of compression spring 52 so that raised portion 94 and notch 98 are retracted. End 38 is aligned with the fastening button 22 of a second, immediately vertically adjacent hub 12. The cutout portion 46 of end cap 44 contacts the beveled portion 118 of the fastening button 22 of the second hub 12. Slide portion 50 is then allowed to move distally, urged by compression spring 52, so that notch 98 engages shank 24 of the fastening button 22. Head portion 26 of the fastening button 22 of the second hub is thus trapped in recessed region 101 between raised portion 94 and end cap 44 at end 38 of support and attachment brace 16, while the inside edge 116 of aperture 40 in tab portion 39 engages the shank 24 of fastening button 22 on the first hub. Support and attachment brace 16 is thus retained on display structure 10 by engagement with the fastening buttons 22 of vertically adjacent hubs 12.

Figure 2:
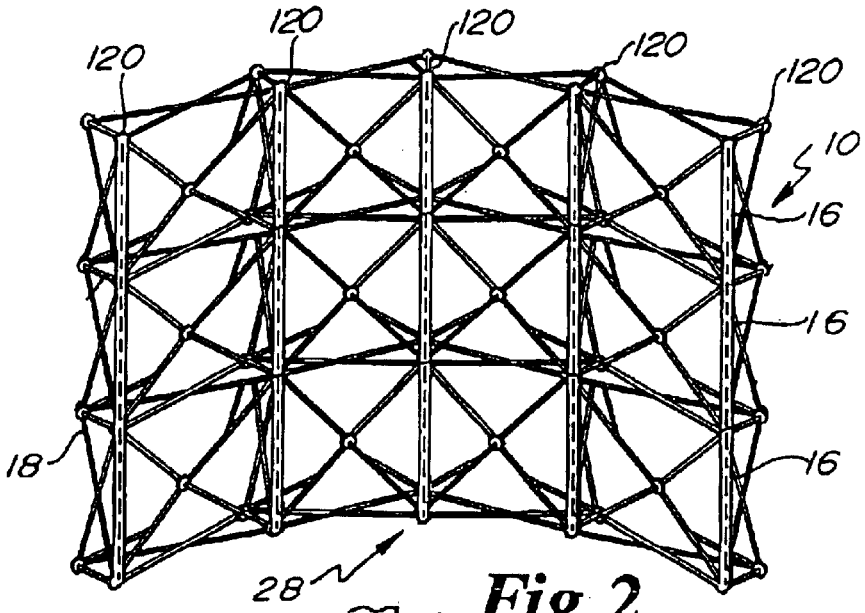
FIG. 2 is a perspective view of a collapsible display framework with a plurality of support and attachment braces attached forming vertical columns.
Figure 4:
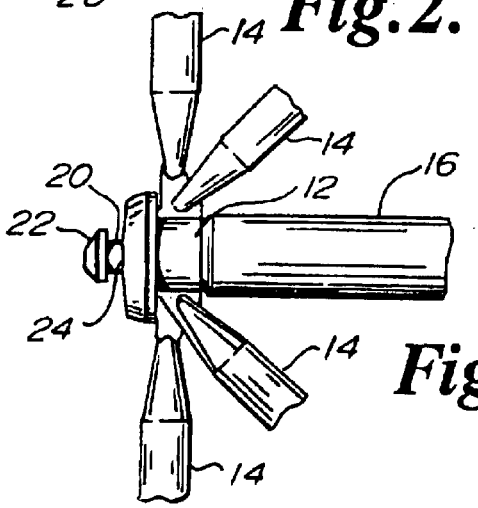
FIG. 4 is a side elevation view of a hub assembly used in the framework.
Figure 7:
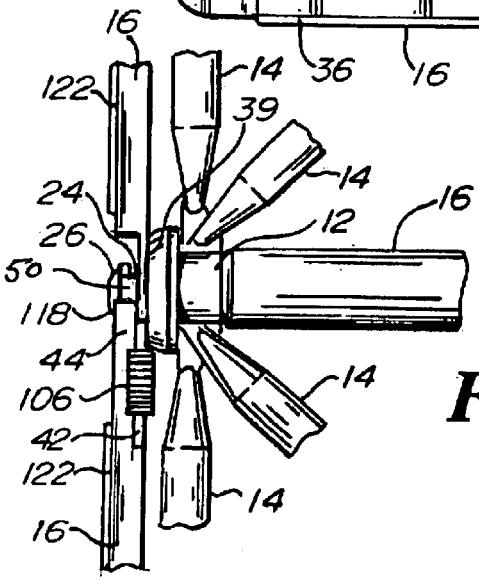
FIG. 7 is a side elevation view of a hub assembly of the display framework with support braces attached to the fastening button of the hub.

As depicted in FIG. 2, multiple support and attachment braces 12 may be successively attached to support structure 12 to form vertical column arrangements 120 for providing vertical support to display structure 10. As depicted in FIG. 7, the slide mechanism 42 of a first brace 16 will overlap the tab portion 39 of a second brace 16 on the same fastening button 22. It will be appreciated, of course, that the aperture 40 of the tab portion 39 of the second brace 16 must be placed over the fastening button 22 before engaging the slide mechanism 42 of the second brace 16 with the button 22. Braces 16 forming a complete column arrangement 120 may be linked together with straps 121 for convenience. The braces 16 may be removed, and display structure 10 collapsed, by the reverse of the procedure described above.

Figure 3:
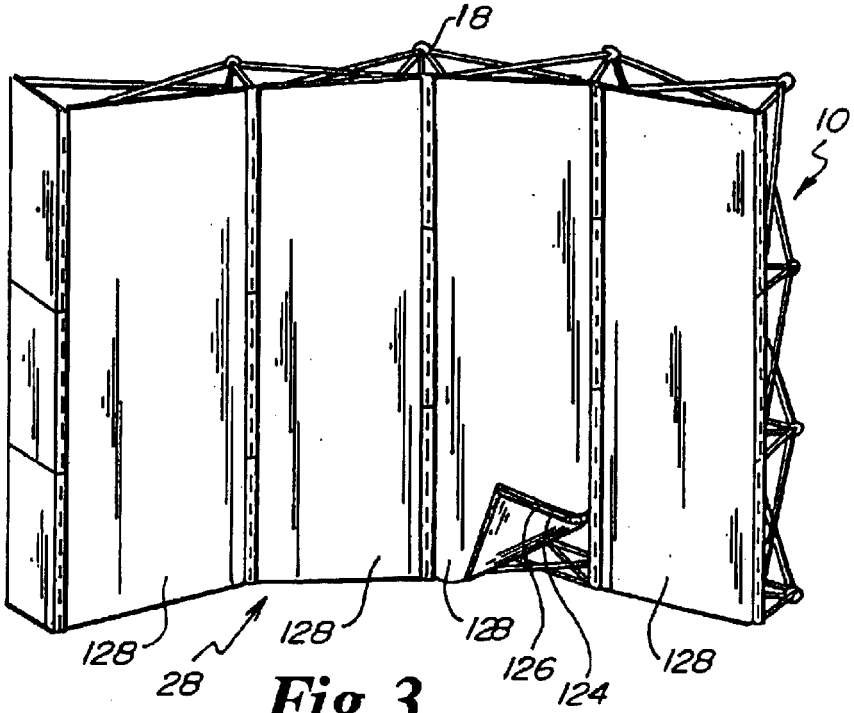
FIG. 3 is a perspective view of the framework with covering material attached.
Figure 5:
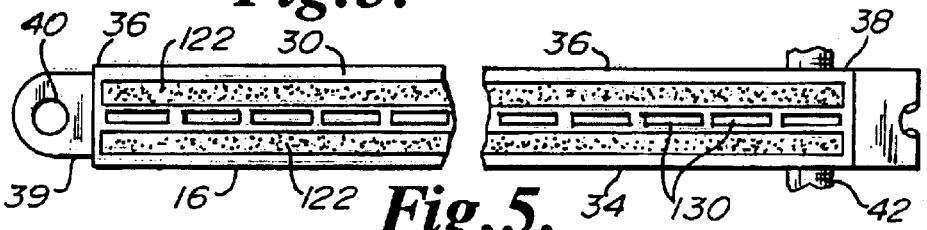
FIG. 5 is a front face plan view of the support and attachment brace of the present invention.
Figure 6:
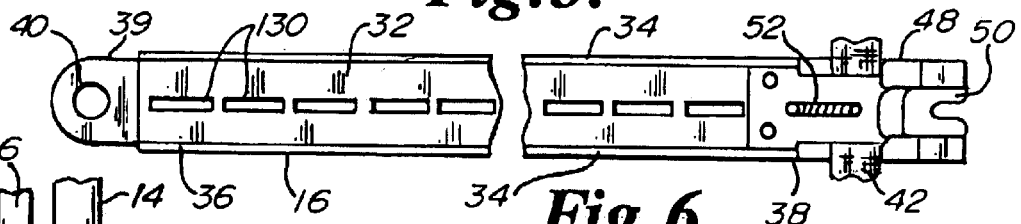
FIG. 6 is a back plan view of the support and attachment brace of the present invention.
Figure 6A:
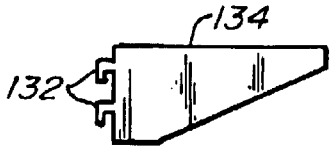
FIG. 6A is a view of a shelving attachment bracket.
Figure 8:
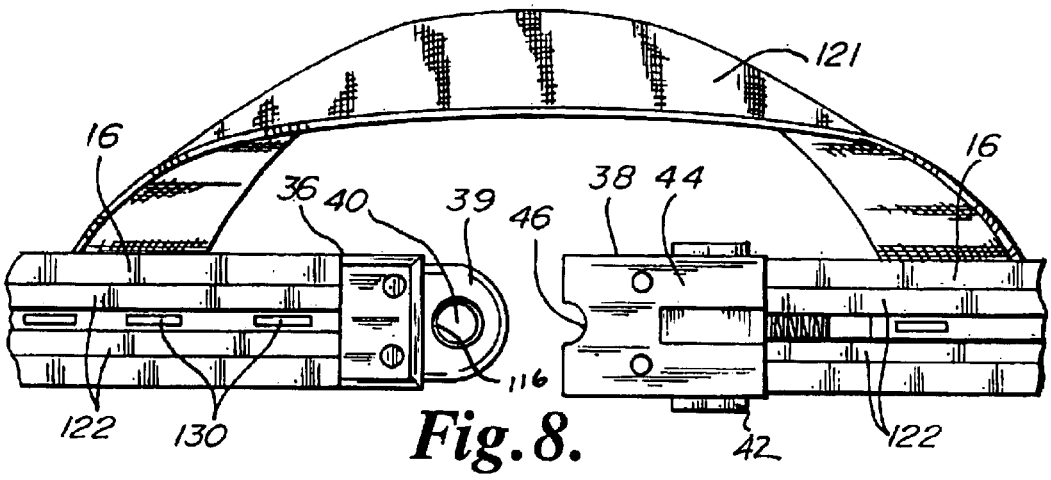
FIG. 8 is a view of the end portions of two braces showing the tab portion of one brace and the slide portion of the other.

As depicted in FIG. 5, support and attachment brace 16 may be adapted for enabling attachment of display covering materials and other items. Magnetic strips 122 may be provided on the front face 30 of the brace 16. Corresponding magnetic or ferrous metallic portions 124 attached to the margins 126 of covering material 128 enable attachment of the covering material 128 to the display structure 10, as depicted in FIG. 3. In addition, slots 130 may be provided along any portion or all of the length of brace 16. Slots 130 may be adapted to receive the engaging hooks 132 of commonly used adjustable shelf brackets 134, depicted in FIG. 6A.

Although slide mechanism 42 is depicted herein as having a compression spring 52 for biasing notch 98 distally to engage shank 24 of a fastening button 22, it will be readily appreciated that a variety of other mechanisms and arrangements for the same purpose are possible and such alternate arrangements are contemplated within the scope of the present invention. Example, any suitably resilient member, material, or mechanism may be substituted for compression spring 50. Also, a snap-action or toggle mechanism having the capability of holding slide portion 50 at a first favored extended position and a second favored retracted position may be substituted for the spring biasing mechanism depicted herein. In addition, it is contemplated that slide mechanism 42 may be used at both ends of the same brace 16.

What is claimed is:

1. A support and attachment brace for a collapsible display structure, said structure having a plurality of projecting fastening buttons, the brace comprising:

an elongate rigid bar portion having a pair of opposing ends;

a tab portion projecting axially from one of said pair of opposing ends, said tab portion having an aperture formed therein, said aperture adapted to receive and engage one of said projecting fastening buttons of said display structure; and a slide portion at the other of said pair of opposing ends of said rigid bar portion, said slide portion having a notch adapted to engage a separate one of said fastening buttons of said display structure, said slide portion being selectively axially slidably positionable relative to the rigid bar portion in at least an extended position for engaging said notch with the fastening button, thereby securing said brace on said display structure, and a retracted position for disengaging said notch from the fastening button, thereby enabling installation and removal of said brace from said display structure.

2. The brace of claim 1, further comprising at least one resilient member arranged so as to bias said slide portion toward said extended position.

3. The brace of claim 2, wherein said resilient member is a spring.

4. The brace of claim 1, wherein said brace has a front face, and further comprising at least one magnetic strip on said front face for attaching items to the brace.

5. The brace of claim 1, wherein said brace has a plurality of slots for receiving a shelf support.

6. A portable collapsible display structure comprising:

a framework including a plurality of support rods pivotally attached to a plurality of hubs, each of said hubs having a fastening button projecting therefrom, said hubs arranged in a plurality of vertical rows; and a plurality of elongate support and attachment braces for vertically supporting said framework, each said brace being vertically positionable between adjacent hubs in one of said plurality of vertical rows, each said brace having a body with a pair of opposing ends, at least one of said ends having a slide portion thereon, said slide portion having an open notch and being selectively axially slidably positionable on the body in at least an extended position for engaging said notch with the fastening button, and a retracted position for disengaging said notch from the fastening button.

7. The display structure of claim 6, wherein said slide portion includes at least one resilient member arranged so as to bias said slide portion toward said extended position.

8. The display structure of claim 6, wherein said resilient member is a spring.

9. The display structure of claim 6, wherein each said brace has a front face, and further comprising at least one magnetic strip on said front face for attaching items to the brace.

10. The display structure of claim 6, wherein each said brace has a plurality of slots for receiving a shelf support.

11. A method of vertically supporting a collapsible display framework, the framework including a plurality of support rods pivotally attached to a plurality of hubs, each of said hubs having a fastening button projecting therefrom, said hubs arranged in a plurality of vertical rows, the method comprising:

providing at least one channel bar;

attaching a tab portion to one end of the channel bar, said tab portion having an aperture dimensioned so as to receive one of said fastening buttons;

attaching a slide mechanism to the other end of the channel bar, said slide mechanism having a slide with an open notch formed therein, said notch adapted to engage one of said fastening buttons, said slide being selectively axially slidably positionable relative to the channel bar in at least an extended position for engaging said notch with the fastening button, and a retracted position for disengaging said notch from the fastening button;

positioning the channel bar between a pair of vertically adjacent hubs in one of said vertical rows;

engaging the aperture in said tab portion with the fastening button of one of said pair of hubs; and engaging the notch with the fastening button of the other of said pair of hubs, thereby affixing the channel bar to the framework.

12. A support and attachment brace for a collapsible display structure, said structure having a plurality of projecting fastening buttons, the brace comprising:

an elongate rigid channel bar portion having a pair of opposing ends; and at least one slide portion at one of said pair of opposing ends, said at least one slide portion having a notch adapted to engage one of said plurality of projecting fastening buttons of said display structure, said slide portion being selectively axially slidably positionable relative to the elongate rigid channel bar portion in at least a first favored extended position for engaging said notch with the fastening button, and a second favored retracted position for disengaging said notch from the fastening button.

13. The brace of claim 12, wherein said slide portion includes at least one resilient member arranged so as to bias said slide portion toward said extended position.

14. The brace of claim 13, wherein said resilient member is a spring.

15. The brace of claim 12, wherein said brace has a front face, and further comprising at least one magnetic strip on said front face for attaching items to the brace.

16. The brace of claim 12, wherein said brace has a plurality of slots for receiving a shelf support.

17. A support and attachment brace for a collapsible display structure, said structure having a plurality of projecting fastening buttons, the brace comprising:

an elongate rigid bar portion having a pair of opposing ends and presenting a longitudinal axis;

first means at one of said pair of opposing ends adapted for receiving and engaging a first one of said plurality of projecting fastening buttons; and second means at the other of said pair of opposing ends of said rigid bar portion for engaging a second one of said plurality of projecting fastening buttons of the display structure, the second means being selectively shiftable along the longitudinal axis of the bar portion between at least a first retracted position wherein the second means clears the second fastening button when the first means is engaged with the first fastening button so that the brace is selectively installable on and removable from the display structure, and a second extended position wherein the second means is engaged with the second fastening button when the first means is engaged with the first fastening button so that the brace is retained on the display structure.

18. The brace of claim 17, wherein said second means includes a slide portion having a notch adapted to engage the second fastening button of said display structure.

19. The brace of claim 18, wherein said slide portion includes at least one resilient member arranged so as to bias said slide portion toward said extended position.

20. The brace of claim 19, wherein said resilient member is a spring.

21. The brace of claim 17, wherein said brace has a front face, and further comprising at least one magnetic strip on said front face for attaching items to the brace.

22. The brace of claim 17, wherein said brace has a plurality of slots for receiving a shelf support.

* * * * *